US008104865B2

(12) United States Patent
Inada et al.

(10) Patent No.: US 8,104,865 B2
(45) Date of Patent: Jan. 31, 2012

(54) INK JET RECORDING APPARATUS AND INK JET HEAD

(75) Inventors: Genji Inada, Koshigaya (JP); Kansui Takino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/482,367

(22) Filed: Jun. 10, 2009

(65) Prior Publication Data

US 2009/0309917 A1 Dec. 17, 2009

(30) Foreign Application Priority Data

Jun. 13, 2008 (JP) ..... 2008-155223

(51) Int. Cl.
*B41J 2/165* (2006.01)

(52) U.S. Cl. ..... 347/20

(58) Field of Classification Search ..... None
See application file for complete search history.

(56) References Cited

U.S. PATENT DOCUMENTS

2007/0273733 A1* 11/2007 Kotaki et al. ..... 347/85
2008/0309739 A1* 12/2008 Takahashi ..... 347/85

FOREIGN PATENT DOCUMENTS

JP 2001-171119 A 6/2001

* cited by examiner

*Primary Examiner* — Matthew Luu
*Assistant Examiner* — Alejandro Valencia
(74) *Attorney, Agent, or Firm* — Canon U.S.A., Inc. IP Division

(57) ABSTRACT

An apparatus includes an ink jet head and a suction mechanism. The head includes liquid chambers connected with ink tanks by flow passages. The flow passages include a non-branching flow passage and a branching flow passage. The suction mechanism sucks the liquid chamber and ejection ports corresponding to the non-branching flow passage and the branching flow passage, respectively at substantially the same pressure. The distance from the flow passage junction to the ejection ports connected to the branching flow passage is shorter than the distance from the flow passage junction to the ejection ports connected to the non-branching flow passage. The volume of the liquid chambers corresponding to the branching flow passage is less than or equal to the volume of the liquid chamber corresponding to the non-branching flow passage.

2 Claims, 9 Drawing Sheets

INK JET RECORDING APPARATUS AND INK JET HEAD

BACKGROUND OF THE INVENTION

1. Field of the Invention

The present invention relates to an ink jet recording apparatus and an ink jet head that eject a plurality of colors of liquid droplets.

2. Description of the Related Art

A color ink jet head disclosed in Japanese Patent Laid-Open No. 2001-171119 is mounted on a reciprocating carriage and can perform printing during both the forward and backward strokes of the carriage (bidirectional configuration).

The example of a bidirectional ink jet head disclosed in Japanese Patent Laid-Open No. 2001-171119 has ink tanks that contain three colors of ink: cyan (hereinafter referred to as C), magenta (hereinafter referred to as M), and yellow (hereinafter referred to as Y). To the three ink tanks are connected five liquid chambers, which are arranged side by side in the back surface of a recording element substrate that ejects liquid droplets.

For example, as shown in FIG. 8, liquid chambers 3*a*, 3*b*, 3*c*, 3*d*, and 3*e* are filled with C, M, Y, M, and C ink, respectively. Y ink is supplied to the Y liquid chamber 3*c* from a Y ink tank 21*b* through a non-branching flow passage 6. C ink is supplied to the two separate C liquid chambers 3*a* and 3*e* from a C ink tank 21*c* through a flow passage divided into two branches 4*a* and 4*e*. Similarly, M ink is supplied to the liquid chambers 3*b* and 3*d* from an M ink tank 21*a* through a flow passage divided into two branches 5*b* and 5*d*.

For descriptive purposes, a liquid chamber corresponding to a non-branching flow passage that connects an ink tank to a liquid chamber will hereinafter be referred to as "non-branching liquid chamber." Liquid chambers corresponding to a branching flow passage that connects an ink tank to a plurality of liquid chambers will hereinafter be referred to as "branching liquid chambers."

In an ink jet head, suction recovery is performed by a purge mechanism in order to discharge bubbles staying in liquid chambers to which liquid is supplied, ejection ports that eject liquid, and flow passages that connect the ejection ports and the liquid chambers, and to fill them with fresh ink.

In particular, bubbles staying in the flow passages and the liquid chambers narrow the ink passages and decrease the performance of ink supply to the ejection ports, and therefore the bubbles are to be reliably removed.

FIG. 8 shows an example of a relatively simple purge mechanism suitable for an ink jet head that includes ejection port arrays corresponding to branching liquid chambers and an ejection port array corresponding to a non-branching liquid chamber, the ejection port arrays being arranged close to each other, as in a bidirectional configuration. By a simultaneous suction operation using a single suction cap 22, the same negative pressure is exerted on the non-branching liquid chamber and the branching liquid chambers, and ink and bubbles are simultaneously discharged through each ejection port array.

With reference to FIGS. 9A to 9D, how a bubble is sucked out of a liquid chamber during a suction operation, will be described.

Reference numeral 9 denotes the entrance of a liquid chamber 3 at which a flow passage is connected to the liquid chamber 3. Before the suction by the purge mechanism, a bubble 10 stays at the entrance 9 (FIG. 9A). The bubble 10 is formed by the union of small bubbles that come from the upstream side (the ink tank side) of the flow passage with consumption of ink during ejection of liquid droplets, and small bubbles formed near an ejection port array 8 (an arrangement of a plurality of ejection ports 8*a* in a line).

One of the causes of the stagnation of the bubble 10 at the entrance 9 of the liquid chamber is that the ink flow speed in this part steeply changes due to the change in cross sectional area of the flow passage. The stagnation or behavior of a bubble can be visualized using a CT scanner (FIG. 9B).

When a suction operation using a suction cup is performed from the undersurface 7 of the recording element substrate 2, the bubble 10 is deformed by the flow of ink from the ink tank to the ejection port array 8 (FIG. 9C). When part of the bubble 10 comes into contact with the ejection port array 8, the meniscus of the bubble 10 breaks, and the bubble 10 is discharged together with ink.

In the case of the non-branching liquid chamber, all of the ink flowing from the ink tank flows into a liquid chamber during a suction operation, and the bubble at the entrance 9 of the liquid chamber can be discharged relatively easily.

However, in the case of a system in which ink is supplied from the same ink tank to two liquid chambers through a branching flow passage, a phenomenon is often observed in which only a bubble in one of the two liquid chambers is discharged and a bubble in the other liquid chamber stays at the entrance 9 of the liquid chamber and is not discharged (FIG. 9D).

This is attributed to the fact that when a bubble in one of the two liquid chambers is discharged during a suction operation, the flow resistance of the liquid chamber decreases, and the ink flow in the other liquid chamber in which a bubble stays, decreases. Therefore, even if the suction operation is continued, the ink in the liquid chamber from which a bubble has been removed is mainly discharged, and ink is hardly discharged out of the liquid chamber in which a bubble stays, and therefore the bubble is not removed.

Bubbles in the system of a branching flow passage and a bubble in the system of a non-branching flow passage can be reliably discharged if each system is individually sucked. However, this method complicates the purge mechanism. Particularly in the case of an ink jet head in which ejection port arrays are arranged close to each other as in the bidirectional configuration, a small and precise suction cap that individually sucks each ejection port array is needed. However, such a suction cap is difficult to make.

To discharge bubbles in both liquid chambers connected to a branching flow passage by sucking a plurality of ejection ports at the same time, a more powerful suction operation needs to be performed, for example, at a larger suction pressure (negative pressure). However, in that case, a needlessly large amount of ink is sucked out of the non-branching liquid chamber, which is sucked at the same time as the branching liquid chambers, and the amount of waste ink that is not used for printing increases.

SUMMARY OF THE INVENTION

The present invention provides an apparatus that reliably removes bubbles in an inkjet head that has a non-branching liquid chamber and branching liquid chambers.

In an aspect of the present invention, an apparatus includes an ink jet head and a suction mechanism. The ink jet head includes liquid chambers that are connected with ink tanks by flow passages and that supply ink to ejection ports. The flow passages include a non-branching flow passage that connects one ink tank to one liquid chamber, and a branching flow passage that connects another one ink tank to two liquid chambers. The suction mechanism sucks the liquid chamber and the ejection ports corresponding to the non-branching flow passage and the branching flow passage, respectively at substantially a same pressure and sucks ink through the ejection ports. The distance from the flow passage junction to the ejection ports connected to the branching flow passage is shorter than the distance from the flow passage junction to the ejection ports connected to the non-branching flow passage.

Further features of the present invention will become apparent from the following description of exemplary embodiments with reference to the attached drawings.

DESCRIPTION OF THE EMBODIMENTS

The embodiments of the present invention will now be described with reference to the drawings.

Figure 1A:
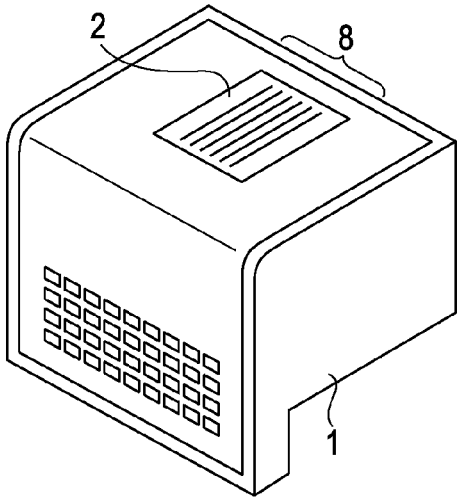
FIGS. 1A to 1C illustrate an ink jet head according to a first embodiment of the present invention.
Figure 1B:
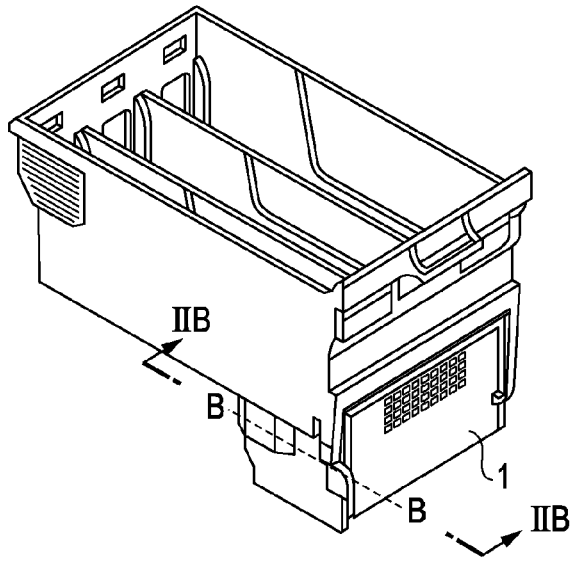
Figure 1C:
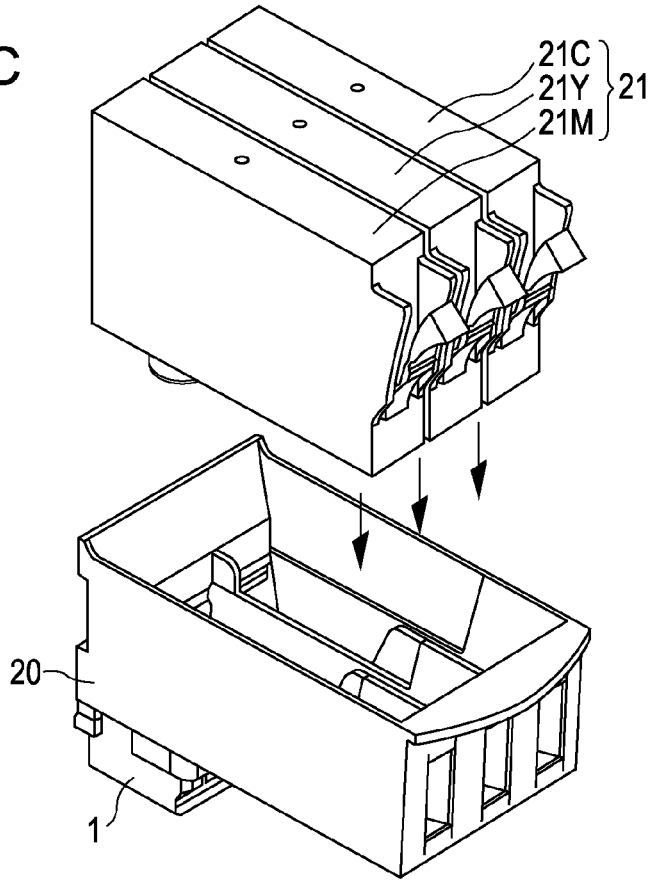
Figure 2A:
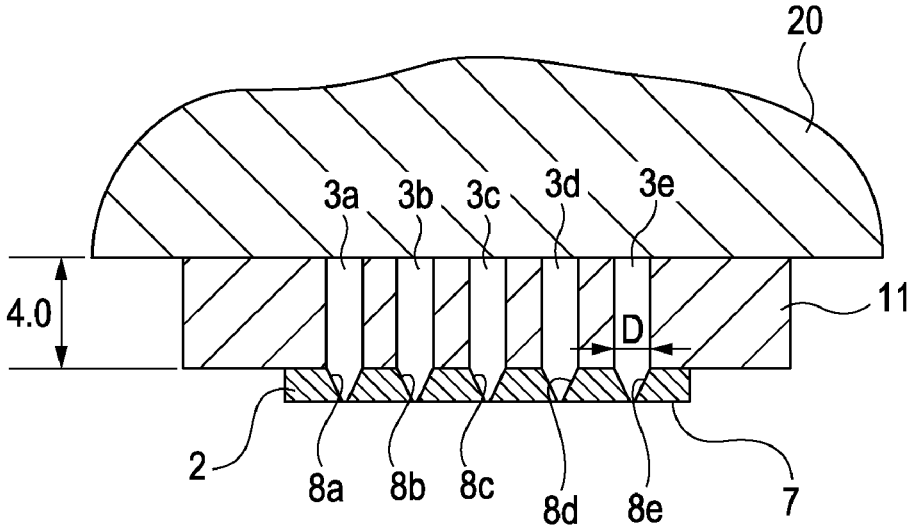
FIGS. 2A and 2B illustrate the structure of liquid chambers according to a first embodiment of the present invention.
Figure 2B:
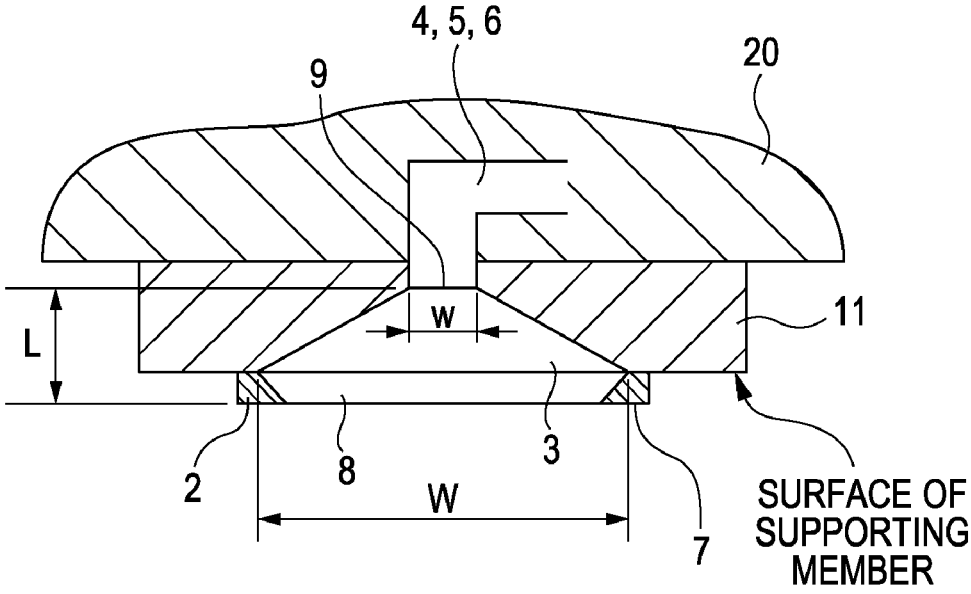
Figure 8:
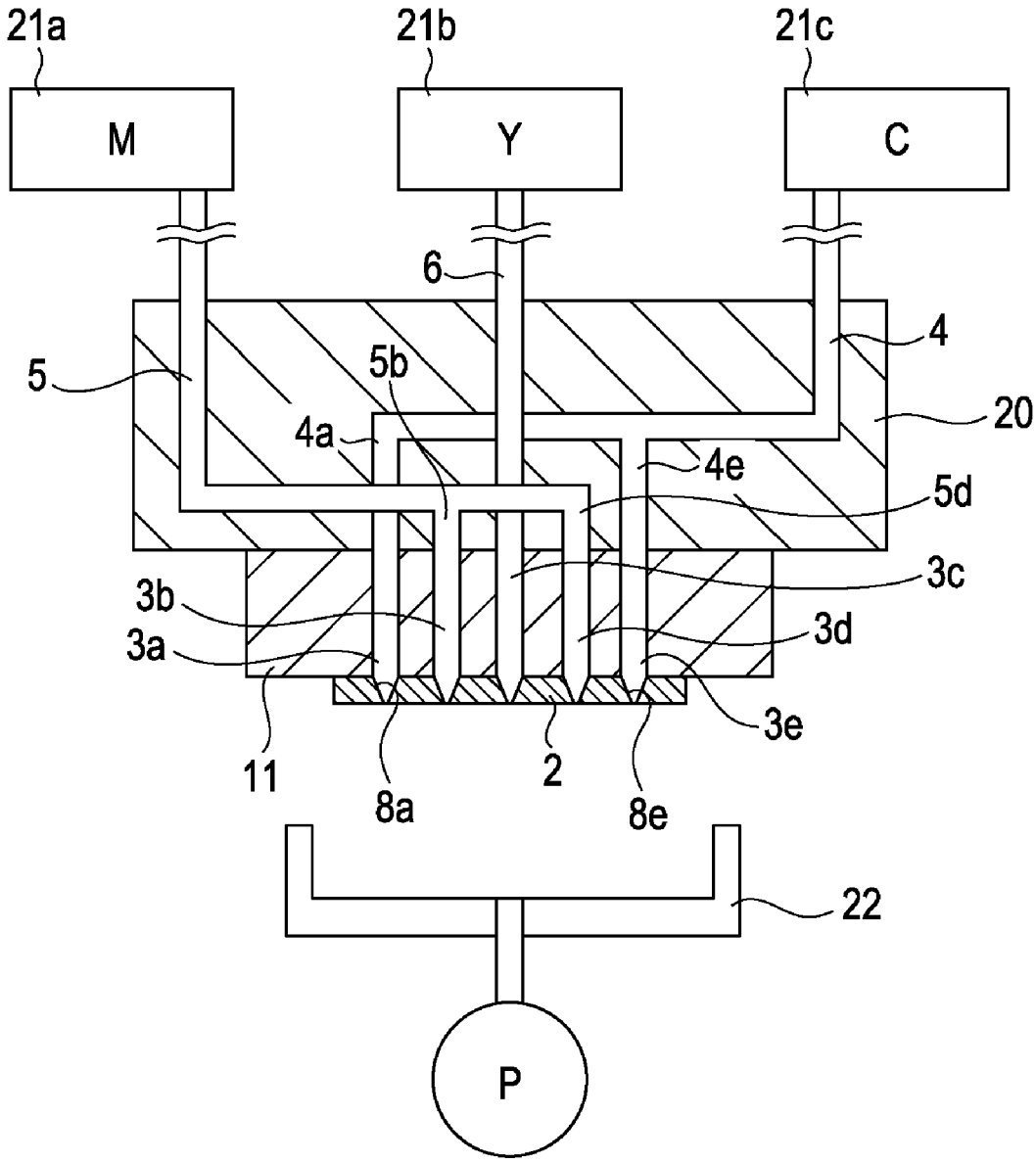
FIG. 8 illustrates the structure of liquid chambers of an ink jet head disclosed in Japanese Patent Laid-Open No. 2001-171119.
Figure 9A:
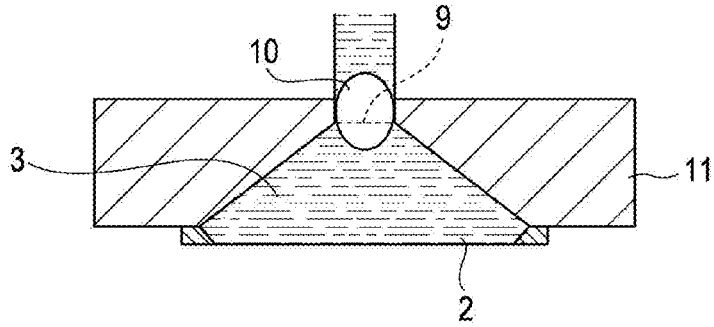
FIGS. 9A to 9D illustrate how a bubble is sucked out of the head of FIG. 8.
Figure 9B:
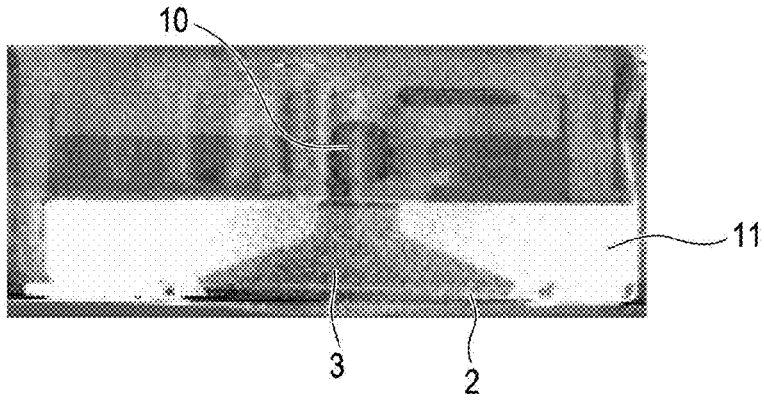
Figure 9C:
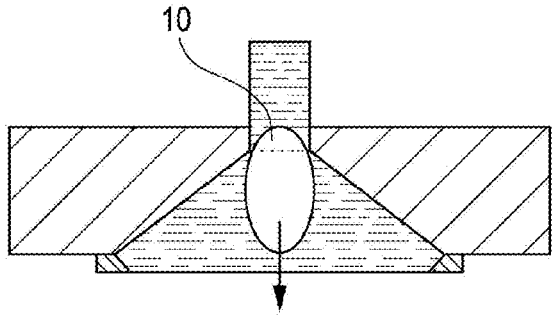
Figure 9D:
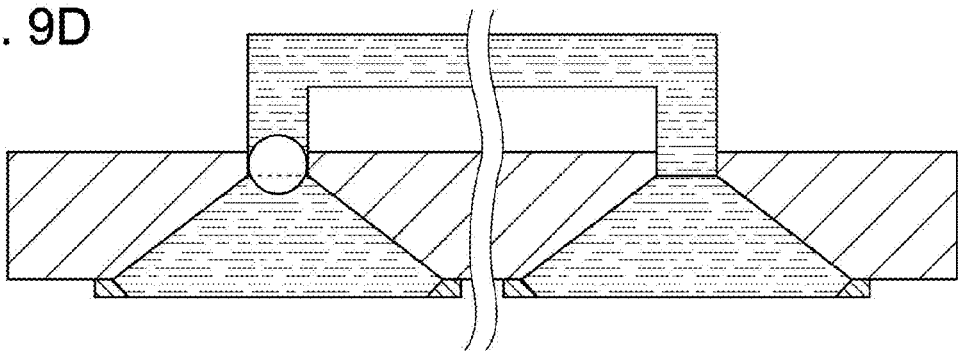

FIGS. 1A to 1C illustrate a bidirectional ink jet head that ejects three colors of ink (C, M, and Y). FIGS. 2A and 2B and 3A to 3C illustrate the structure of liquid chambers. The suction operation for discharging bubbles, for example, in ejection ports, is performed by the above-described purge mechanism of FIG. 8.

The ink jet head 1 according to this embodiment is joined to a tank holder 20 on which are mounted ink tanks 21 that contain three colors of ink (C, M, and Y).

In one embodiment, the ink jet head 1 has a recording element substrate 2 that is a silicon substrate 0.625 mm thick having energy generating elements (not shown) that generate energy used to eject liquid. The ink jet head 1 also has a supporting member 11 that is an alumina (aluminum oxide) plate 4.0 mm thick supporting the recording element substrate 2, and five liquid chambers 3*a* to 3*e* formed in the supporting member 11.

The recording element substrate 2, which ejects three colors of ink, has five ejection port arrays 8*a* to 8*e* corresponding to the liquid chambers 3*a* to 3*e*, respectively. Ink is supplied from the back side of the recording element substrate 2 through the liquid chambers. In each ejection port array, 128 ejection ports are arranged approximately linearly in the direction of line IIB-IIB of FIG. 1B at intervals of 600 dpi.

The liquid chambers 3*a* to 3*e* are filled with C, M, and Y ink. Y ink flows from an ink tank 21Y for Y ink through a non-branching flow passage, which is connected to the middle liquid chamber 3*c* of the supporting member 11. C ink flows from an ink tank 21C for C ink through a bifurcate flow passage, which separates just before the liquid chambers. The branches of the bifurcate flow passage are connected to the liquid chambers 3*a* and 3*e*. Similarly, M ink flows from an ink tank 21M for M ink through a bifurcate flow passage, which separates just before the liquid chambers. The branches of the bifurcate flow passage are connected to the liquid chambers 3*b* and 3*d*.

The above-described flow passages are formed in the tank holder 20.

The cross section of the five liquid chambers 3*a* to 3*e* taken along the direction in which the ejection ports are arranged, is trapezoidal (FIG. 2B) so that ink can flow smoothly in the liquid chambers. The lower base of the trapezoid corresponds to the surface of the supporting member 11 on which the recording element substrate 2 is mounted.

The thickness D (FIG. 2A) of the liquid chambers in the direction in which the liquid chambers are arranged, is 0.65 mm. The width W (FIG. 2B) of the liquid chambers corresponding to the lower base of the trapezoid is larger than the length of the ejection port arrays. The liquid chambers have the same width W of 6.6 mm. The part of each liquid chamber corresponding to the upper base of the trapezoid is an entrance 9 to which is connected a corresponding one of the flow passages leading from the ink tanks.

Ink is supplied from the horizontal parts of the flow passages formed in the tank holder 20 through the vertical parts of the flow passages to the liquid chambers 3. The entrances 9 of the liquid chambers have the same width w (FIG. 2B) of 1.15 mm.

Immediately upstream of (on the ink tank side of) the entrance 9 of each liquid chamber is the vertical part of the corresponding flow passage. In this part, there is not a steep increase in cross sectional area. Therefore, in this part, a bubble is moved with relative ease by the flow of ink during recording or suction. Downstream of (on the ejection port array 8 side of) the entrance 9 of each liquid chamber, the cross sectional area increases steeply and the speed of ink flow decreases. Therefore, a bubble 10 tends to stay near the entrance 9 of each liquid chamber at a position opposite the ejection port array 8.

Figure 3A:
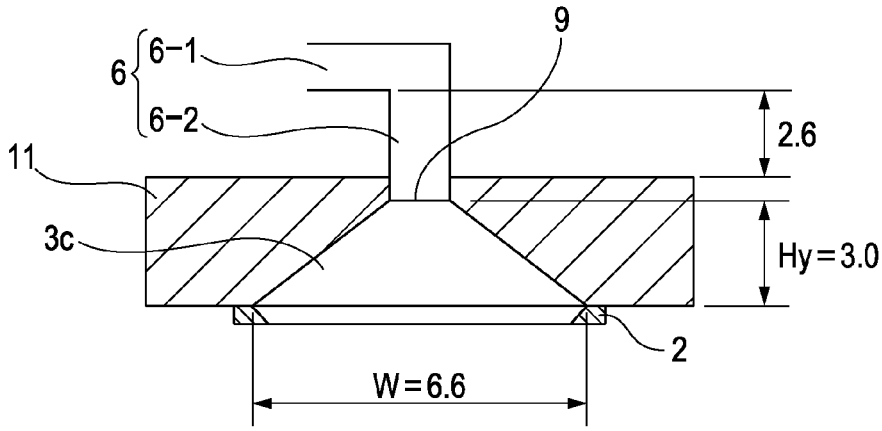
FIGS. 3A to 3C illustrate the structure of liquid chambers according to a first embodiment of the present invention.
Figure 3B:
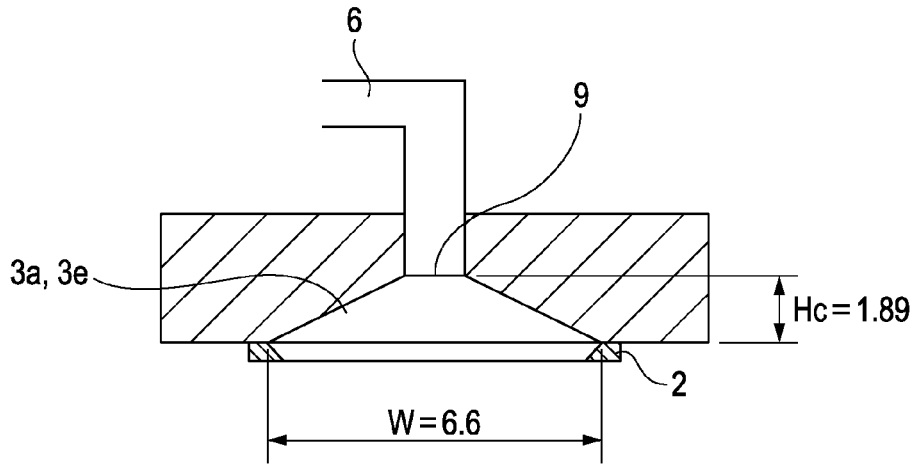

In this embodiment, the height Hy of the liquid chamber 3*c* for Y connected to the non-branching flow passage 6 is 3.0 mm (FIG. 3A), and the height Hc of the liquid chambers 3*a* and 3*e* for C connected to the branches 4*a* and 4*e* of the bifurcate flow passage 4 is 1.89 mm (FIG. 3B). Similarly, the height of the liquid chambers 3*b* and 3*d* for M is 1.89 mm.

The distance L (FIG. 2B) from the entrance 9 of each liquid chamber to the ejection port array 8 is the sum of the height of the liquid chamber and the thickness of the recording element substrate 2. Therefore, the distance L of the non-branching liquid chamber 3*c* for Y is larger than that of the branching liquid chambers 3*a*, 3*b*, 3*d*, and 3*e* for the other colors. More specifically, L is the distance from the entrance 9 of each liquid chamber to the nearest one of the ejection ports.

As described above, a bifurcate flow passage 4 that separates just before the liquid chambers is connected to the pair of liquid chambers 3*a* and 3*e* for C. Small bubbles formed in the part of the flow passage 4 between the ink tank 21*c* and the bifurcation are divided in two and flow into the liquid chambers 3*a* and 3*e*. All the bubbles in the Y flow passage 6 flow into the liquid chamber 3*c* for Y.

The bubbles in the liquid chambers 3*a* to 3*e* are discharged by suction at the same time. Therefore, it is desirable that the volume of the liquid chamber 3*c* be larger than the volume of the other liquid chambers.

Figure 3C:
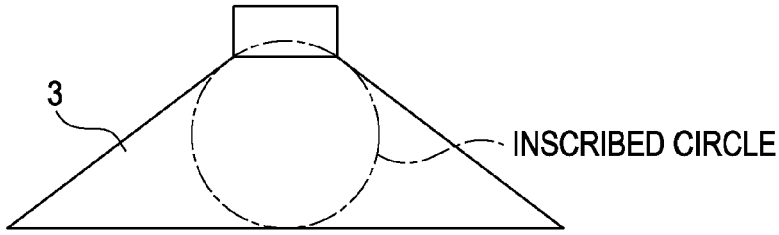

When a bubble removed from the entrance 9 of a liquid chamber flows into the liquid chamber, the volume of the largest bubble that can be held in the liquid chamber when there is no flow of ink can be simply estimated from the area of the inscribed circle of the liquid chamber as shown in FIG. 3C. In this embodiment, the radius of the inscribed circle of the liquid chamber 3*c* is about 2.9 mm, and the radius of the inscribed circle of the other liquid chambers is about 2.0 mm. The liquid chamber 3*c* has about double the bubble buffer capacity of the other liquid chambers.

Figure 4A:
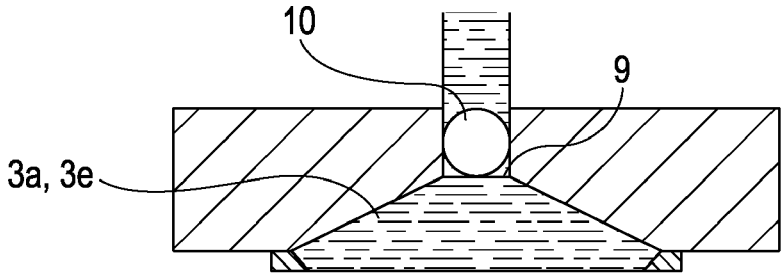
FIGS. 4A to 4C illustrate the structure of liquid chambers according to a first embodiment of the present invention.
Figure 4B:
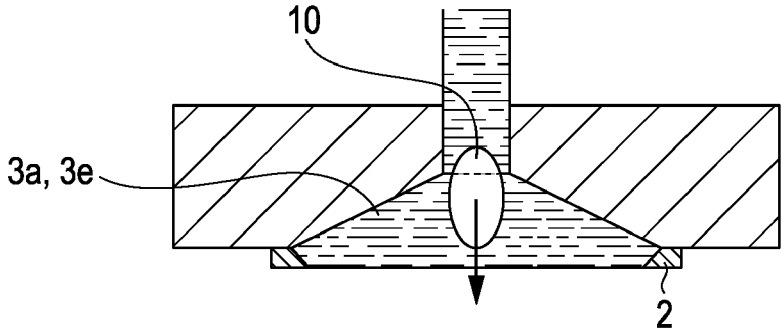
Figure 4C:
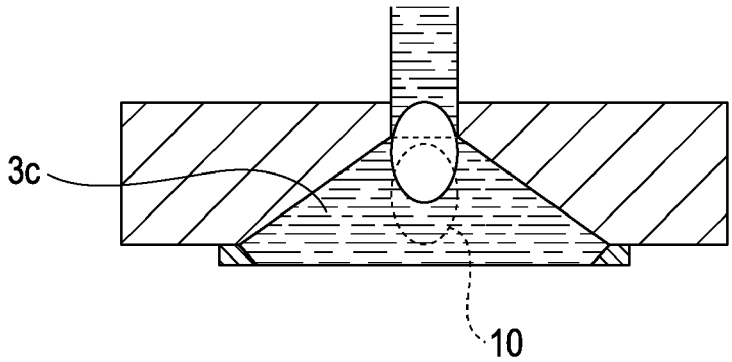

Next, the bubble behavior during a suction operation will be described with reference to FIGS. 4A to 4C.

If a bubble 10 is removed from the entrance 9 of a liquid chamber by the flow of ink during a suction operation, the bubble 10 is discharged through the ejection ports. If the bubble 10 is not removed by the flow of ink, the bubble 10 is deformed so as to extend toward the bottom of the liquid chamber (FIG. 4B).

When a bubble 10 stays at each of the entrances 9 of the liquid chambers 3*a* and 3*e* connected to the branching flow passage 4, the same rate of ink flow is produced in both of the liquid chambers. It is assumed that the bubble in one of the liquid chambers is discharged and the flow of ink in the other liquid chamber decreases and thereby the deformation of the bubble 10 decreases. The distance from the entrance 9 of the liquid chamber to the ejection port array 8 is relatively small. Therefore, a suction condition that enables the bubble 10 to reach the ejection port array, is selected, and the bubble 10 can be easily discharged (FIG. 4B).

In this embodiment, all of the liquid chambers have the same width W and thickness D, and therefore all of the ejection port arrays are sucked using the same suction cap, and substantially the same pressure (negative pressure) acts on the five ejection port arrays and the five liquid chambers. Therefore, bubbles are deformed toward the ejection port arrays 8 in the same manner.

Therefore, the bubbles in the branching liquid chambers, in which the distance from the entrance 9 to the ejection port array 8 is relatively small, more easily reach the ejection port array 8 than the bubble in the non-branching liquid chamber. As a result, the difference in bubble removal timing between branching liquid chambers connected to the same tank is expected to decrease, and the bubbles in the branching liquid chambers can be reliably discharged without sucking a large amount of ink.

If the height L of the liquid chambers 3*a* and 3*e* is equal to the height of the liquid chamber 3*c* as in the known art, the bubble 10 needs to be more significantly deformed (see the bubble 10 shown by a dashed line in FIG. 4C), and a larger amount of ink needs to be discharged.

If the height of the liquid chamber 3*c* connected to the non-branching flow passage is equal to the height of the liquid chambers 3*a*, 3*b*, 3*d*, and 3*e*, the ease of removal of a bubble from the liquid chamber 3*c* improves. However, such a configuration is unfavorable when all of the liquid chambers have the same thickness W as in this embodiment. The reason is that the liquid chambers function as buffers for storing small bubbles that are formed in the ink tanks or the flow passages and that are carried into the liquid chambers by the flow of ink. The non-branching flow passage 6 is connected to a single liquid chamber 3*c*. Therefore, it is desirable to make the height of the liquid chamber 3*c* as large as possible so that the liquid chamber 3*c* can hold more bubbles.

In this embodiment, branching liquid chambers and a non-branching liquid chamber correspond to a single recording element substrate and are sucked using a single suction cap at the same time. The present invention can also be applied to other purge configurations shown in FIGS. 5A and 5B.

Figure 5A:
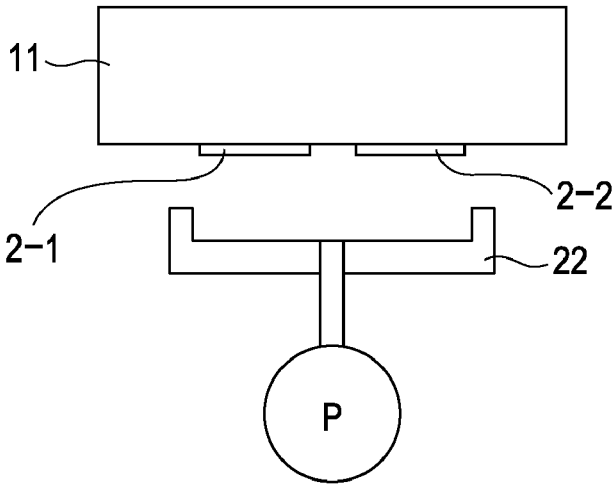
FIGS. 5A and 5B each illustrate a purge mechanism according to a first embodiment of the present invention.
Figure 5B:
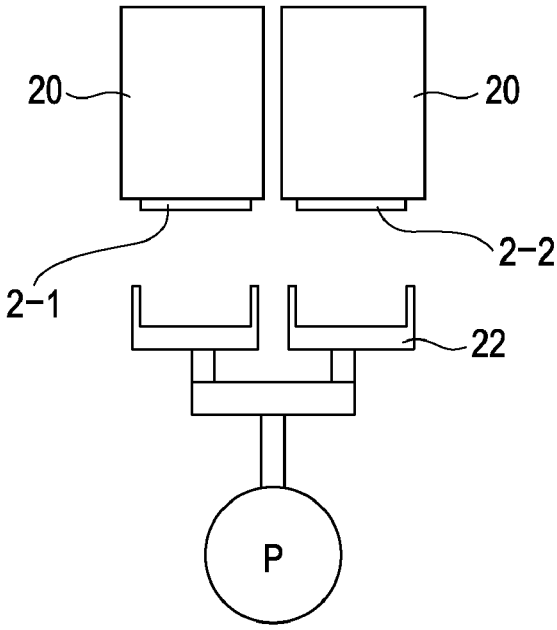

FIG. 5A shows an example in which two recording element substrates 2-1 and 2-2 that are mounted on the same supporting member 11 and that each have branching liquid chambers and a non-branching liquid chamber, are sucked using a single suction cap 22. FIG. 5B shows an example in which two recording element substrates 2-1 and 2-2 that are separately connected to each of two ink tank holders 20, each include at least one branching liquid chamber and non-branching liquid chambers.

FIGS. 6A, 6B, 7A, and 7B illustrate other embodiments.

Figure 6A:
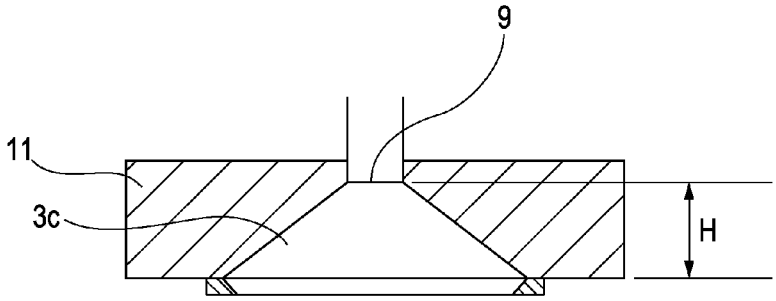
FIGS. 6A and 6B illustrate another embodiment of the present invention.
Figure 6B:
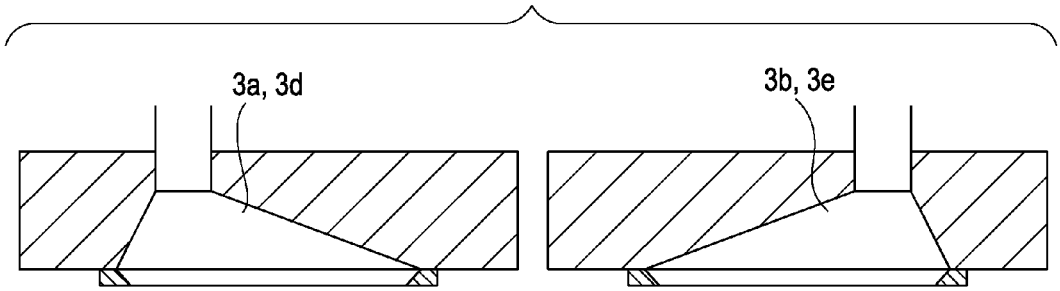

FIGS. 6A and 6B show an example in which the shape of liquid chambers at cross section taken along the direction in which ejection ports are arranged is not an isosceles trapezoid. The height of the branching liquid chambers 3*a*, 3*b*, 3*d*, and 3*e* is shorter than the height H of the non-branching liquid chamber 3*c*.

Figure 7A:
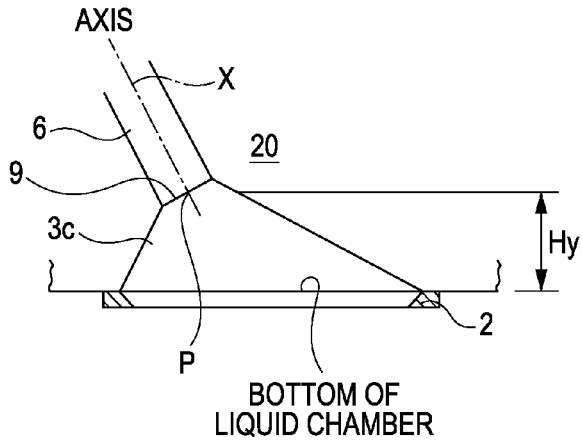
FIGS. 7A and 7B illustrate another embodiment of the present invention.
Figure 7B:
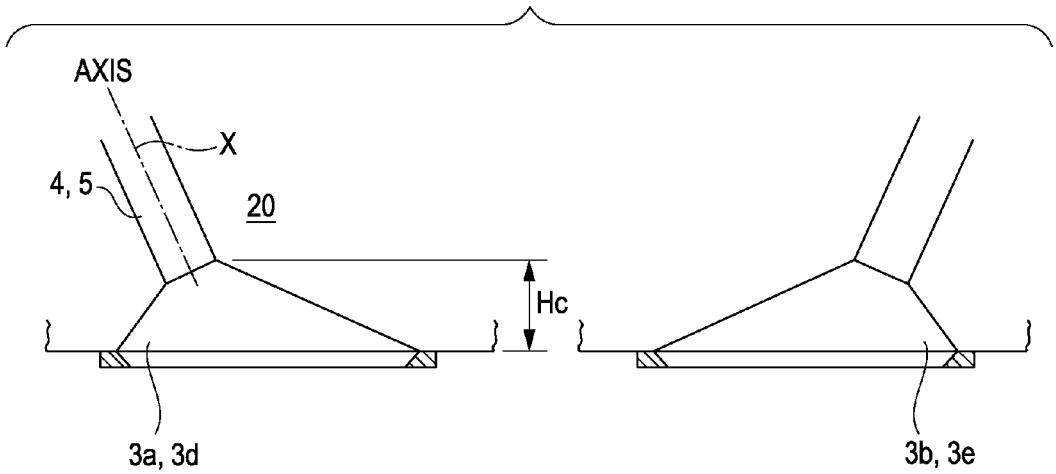

FIGS. 7A and 7B shows an example in which the flow passages 4, 5, and 6 are obliquely connected to liquid chambers with respect to the surface of the recording element substrate 2. A bubble staying at the entrance 9 of a liquid chamber is expected to deform from the point P of intersection of the axis X of flow passage with the liquid chamber during a suction operation. Therefore, the height Hy of a liquid chamber is defined as the distance from the point P of intersection of the axis X of flow passage with the entrance 9 of the liquid chamber to the bottom surface of the liquid chamber. The height of the branching liquid chambers 3*a*, 3*b*, 3*d*, and 3*e* is shorter than the height Hy of the non-branching liquid chamber 3*c*.

According to the above-described embodiments of the present invention, the following advantageous effects are achieved.

In the known ink jet head in which the cross sectional area of flow passages increases steeply at the entrance of each liquid chamber to which is connected a corresponding one of the flow passages leading from ink tanks, a bubble stays near the entrance of each liquid chamber. In the present invention, two types of liquid chambers have substantially the same length, and the volume of the branching liquid chambers is not more than the volume of the non-branching liquid chamber. Therefore, bubbles near the entrances of the two types of liquid chambers deform so as to extend toward the ejection port array through which ink is discharged during a suction operation. In the branching liquid chambers, the distance from the entrance to the ejection port array is short compared to the non-branching liquid chamber. Therefore, the bubbles near the entrances of the branching liquid chambers easily reach the ejection port array, and are relatively easily discharged.

Using this configuration improves the imbalance in suction condition for discharging bubbles between the liquid chambers and ejection port arrays connected to the branching flow passages and the liquid chamber and ejection port array connected to the non-branching flow passage, which are sucked substantially at the same time. As a result, bubble discharge in the liquid chambers and ejection port arrays connected to the branching flow passages and the liquid chamber and ejection port array connected to the non-branching flow passage can be reliably performed at the same negative pressure.

As a result, the amount of waste ink can be reduced not only in the branched flow passage system but also in the non-branching flow passage system that is sucked at the same time as the branched flow passage system and in which bubble discharge is relatively easy.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-155223 filed Jun. 13, 2008, which is hereby incorporated by reference herein in its entirety.

What is claimed is:

1. An apparatus comprising:

an ink jet head including a recording element substrate including energy generating elements and ejection ports, flow passages connected to an ink tank for supplying ink to the recording element substrate, and liquid chambers, having connected portions to be connected to the flow passages and portions where cross sectional areas of the liquid chambers increase from the connected portions toward the recording element substrate, configured to supply ink sent from the flow passages to the recording element substrate, the liquid chambers including a first liquid chamber and second liquid chambers, the flow passages including a first flow passage that connects one ink tank to the first liquid chamber and a second flow passage that connects another ink tank to the second liquid chambers and that includes, in the second flow passage, a branching portion that branches into the second liquid chambers; and a suction mechanism that sucks ink through both the ejection ports connected to the first liquid chamber and the ejection ports connected to the second liquid chambers, wherein each of the distances from the connected portions of the second liquid chambers to the ejection ports connected to the second liquid chambers is shorter than a distance from the connected portion of the first liquid chamber to the ejection ports connected to the first liquid chamber.

2. The apparatus according to claim 1 wherein each volume of the second liquid chambers is less than or equal to a volume of the first liquid chamber.

* * * * *